United States Patent [19]

Miller

[11] Patent Number: 4,953,985

[45] Date of Patent: Sep. 4, 1990

[54] MIXING STRUCTURE FOR PAINT COLORANT IN A DISPENSING APPARATUS

[75] Inventor: William A. Miller, Buffalo Grove, Ill.

[73] Assignee: Fluid Management Limited Partnership, Wheeling, Ill.

[21] Appl. No.: 381,046

[22] Filed: Jul. 17, 1989

[51] Int. Cl.[5] ..... B01F 7/16

[52] U.S. Cl. ..... 366/244; 366/245; 366/246; 366/251; 366/347; 366/605

[58] Field of Search ..... 366/245, 244, 247, 249, 366/251, 252, 253, 605, 246, 261, 279, 297, 347, 292

[56] References Cited

U.S. PATENT DOCUMENTS

| | | | |
|---|---|---|---|
| 2,603,461 | 7/1952 | Marienthal | 366/251 |
| 2,923,438 | 2/1960 | Logan | 366/605 |
| 4,225,248 | 9/1980 | Para | 366/251 |
| 4,813,785 | 3/1989 | Miller | 366/605 |

*Primary Examiner*—Robert W. Jenkins

*Attorney, Agent, or Firm*—Fitch, Even, Tabin & Flannery

[57] ABSTRACT

An apparatus for mixing liquid paint colorant in a plurality of containers. Flexible cables are rotated about their length by a drive motor to rotate agitators in each container. The cable ends which drive the agitators are aligned with the rotational axes of the agitators. Each container has an open upper end which is closed by a cover having an attached mechanism for imparting rotation from the cables to the agitators. The agitators are disabled by disengaging one end of the cable from the drive motor, disengaging the other end of the cable from the mechanism on the container cover, or removing the cover with the cable intact to separate the mechanism from the agitator. The cables are bowed in an inverted U-shape between the drive motor and container covers. A lid extends over the bowed cables and has a rim that bears against the container covers to maintain them in closed position on the container during operation.

28 Claims, 4 Drawing Sheets

MIXING STRUCTURE FOR PAINT COLORANT IN A DISPENSING APPARATUS

BACKGROUND OF THE INVENTION

1. Field of the Invention

This invention relates to apparatus for dispensing paint colorant selectively from a plurality of containers and, more particularly, to structure for agitating the colorant in the containers.

2. Description of Related Art

To avoid having to separately inventory different color paints, paint retailers use a common base that is tinted with a colorant on a per order basis. An elevated turntable supports a plurality of containers in which the colorant is stored in liquid form and metering structure is provided to dispense predetermined amounts of each colorant from the containers into the base in proportions dictated by the desired color.

To maintain uniformity from one paint batch to the next, it is essential that the colorant in each container be thoroughly mixed. To accomplish this, it is conventional to equip each container with a rotary agitator which is periodically operated to mix the colorant.

SUMMARY OF THE INVENTION

The present invention is directed to an apparatus for mixing a liquid colorant in a container. A flexible cable is rotated about its length to drive rotatable agitators in the container.

Where a plurality of containers with separate colorant supplies are used, each container has its own agitator and associated cable connected to the agitator. A motor driven gear simultaneously rotates the cables, through a gear on each cable.

Each cable has a surrounding sheath with opposite ends connected to a fixed housing associated with the drive gear and a block on the container, to thereby maintain a predetermined bend in the cable. Each cable drives a gear about a horizontal axis in mesh with a gear on the agitator rotatable about a vertical axis. The motor driven gear is spaced below the block on the container and is rotatable about a vertical axis. The gears on the cable ends, in mesh with the motor driven gear, are rotatable about axes parallel to the axis of the motor driven gear and spaced equidistantly therefrom.

In a modified form of the invention, the cables are keyed directly to the agitators, thereby obviating the need for cooperating gears between the cable and agitator. A shaft with a connector, for releasably engaging the agitator, is journalled for rotation in each container lid. A sleeve projects upwardly from each container lid and embraces the cable sheath to maintain vertical orientation thereof above the cover. The cable core is releasably keyed directly to the shaft.

The invention also contemplates that the cables be arranged in a predetermined pattern to avoid entanglement therebetween and provide an aesthetically pleasing structure. A housing over the drive motor maintains the driven ends of the cables in vertical orientation. Preferably, the housing is below the container covers and in one arrangement is centrally of an annular arrangement of the containers. The cables are bowed so as to have an inverted U-shape.

Preferably, each container has an open upper end which is closed by a cover that is press fit to the container. It is another aspect of the invention to provide a lid that serves the dual function of maintaining the container covers in their closed position and simultaneously shielding the cables and drive structure therefor. With the containers in an annular arrangement the lid has an inverted cup shape with a rim that bears simultaneously against the container covers. The weight of the cover is sufficient to keep the covers in place as the apparatus is operated. The lid has a body with a contour conforming generally to the bow of the cables and an outturned rim which bears against the covers. An annular lip depends from the rim and surrounds the containers so as to consistently locate the lid relative to the containers with the lid in its operative position. The lid shields the cables, containers and drive for the cables from foreign matter and also contributes to an aesthetically pleasing structure.

To further maintain the orientation of the cables, a spacer plate can be provided having notches to seat each of the cables.

The present invention also contemplates an alternative agitator drive system wherein a drive motor is mounted on the turntable for rotation therewith. Commutator rings and brushes below the turntable provide electrical power to the drive motor during operation of the turntable.

BRIEF DESCRIPTION OF THE DRAWINGS

In the drawings, wherein like elements are referenced alike.

DETAILED DESCRIPTION OF THE PREFERRED EMBODIMENTS

Figure 1:
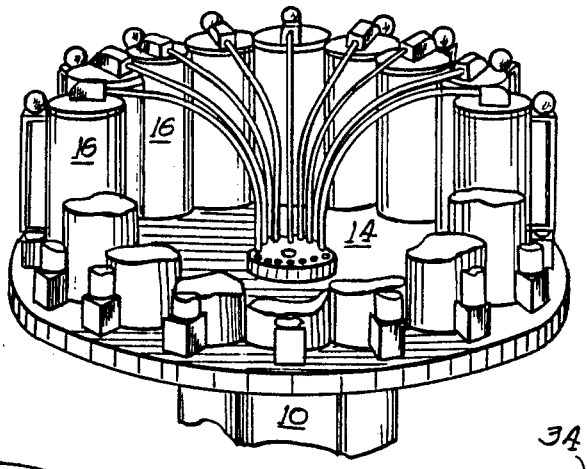
FIG. 1 is a perspective view of a liquid colorant mixing and dispensing apparatus with a plurality of cable driven agitators for colorant containers according to the present invention.
Figure 2:
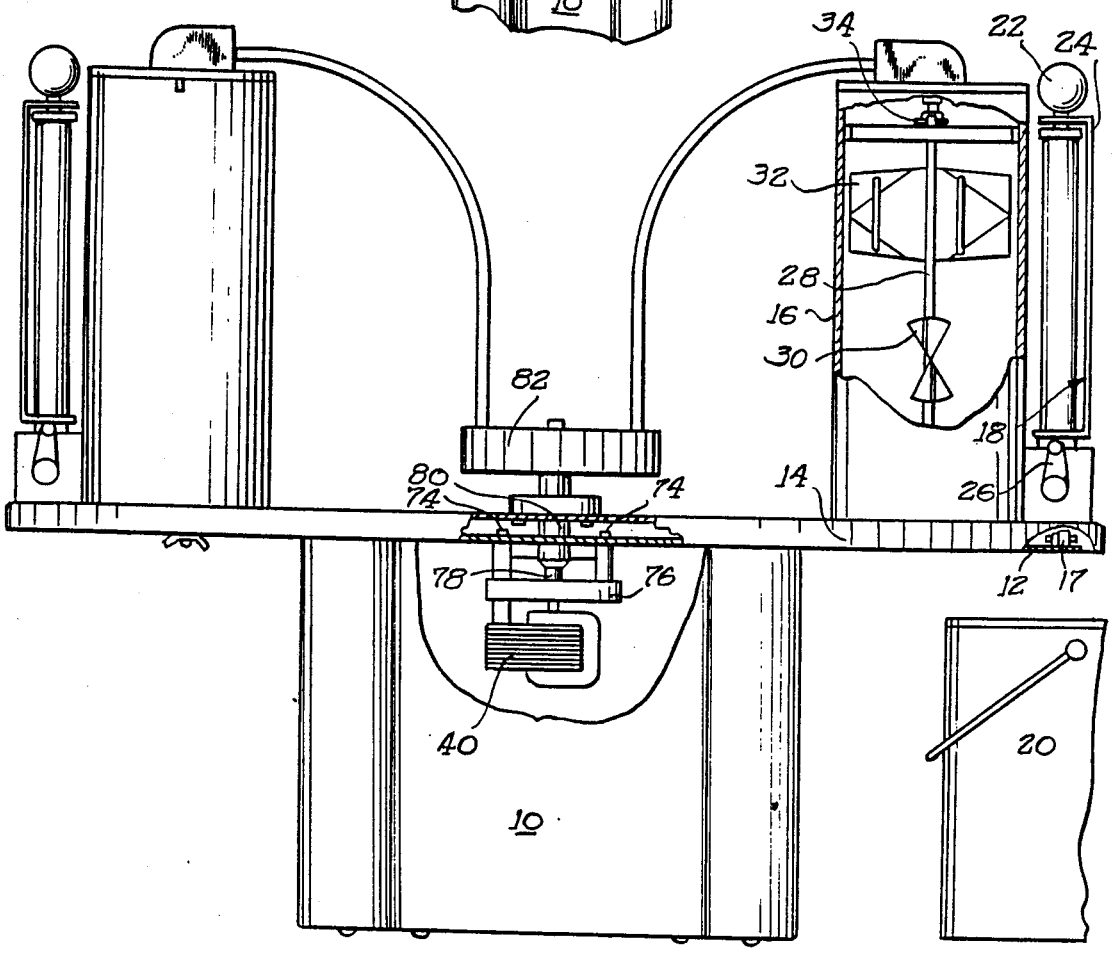
FIG. 2 is an enlarged elevational view of the colorant mixing and dispensing apparatus of FIG. 1.
Figure 3:
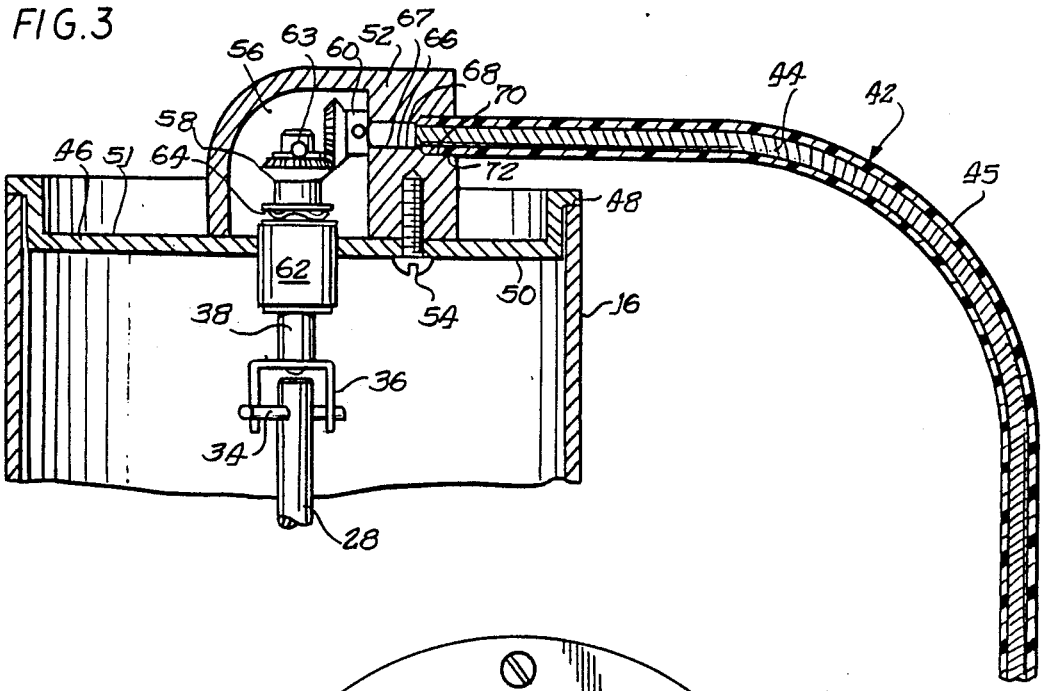
FIG. 3 is an enlarged, fragmentary sectional view of the connection between a drive cable and an agitator on one of the colorant containers.
Figure 4:
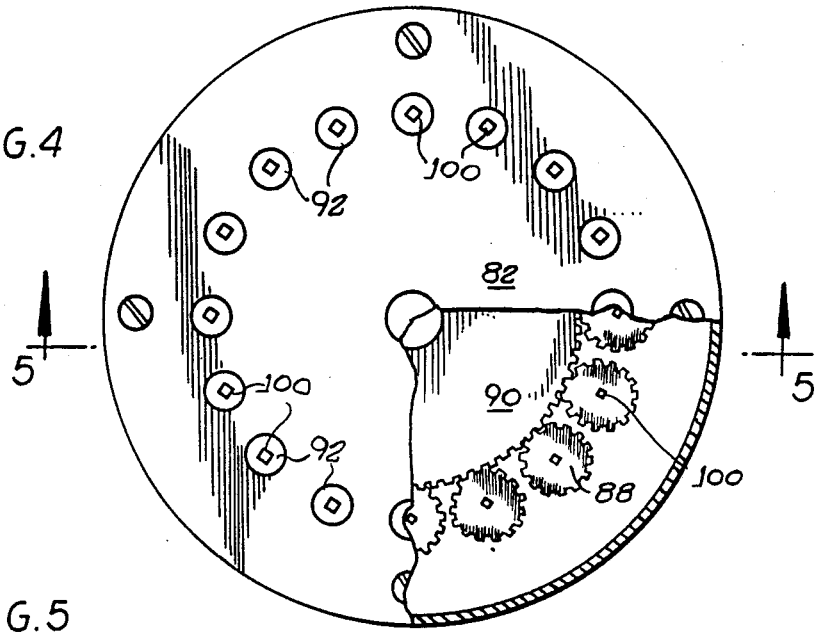
FIG. 4 is an enlarged, plan view of drive structure for the cables.
Figure 5:
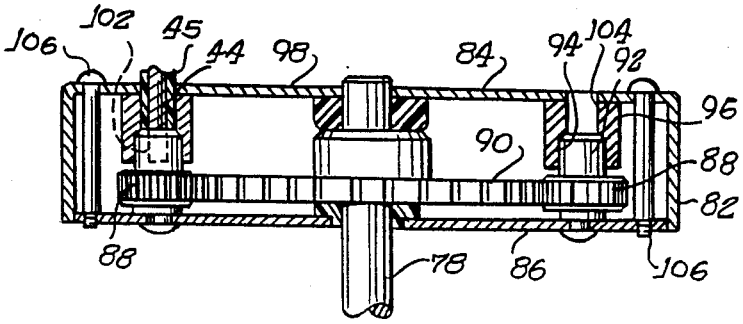
FIG. 5 is a sectional view of the drive structure taken along line 5—5 of FIG. 4.
Figure 6:
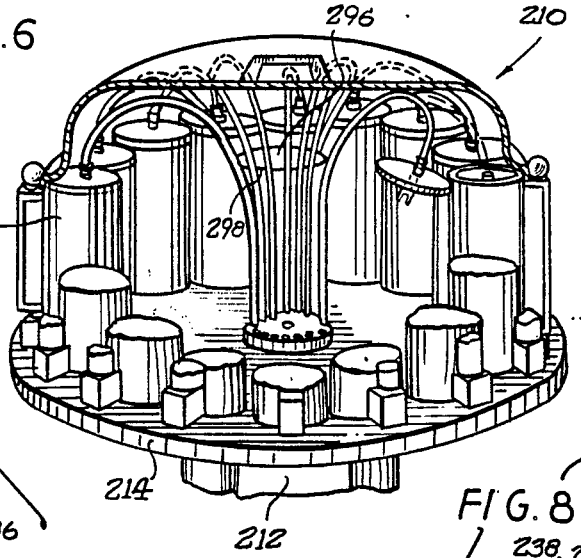
FIG. 6 is a modified form of liquid colorant mixing and dispensing apparatus according to the present invention.

Referring initially to FIGS. 1 and 2, the colorant mixing and dispensing apparatus according to the present invention consists of a cylindrical base 10, having fixed thereto a disk-shaped support 12 for a turntable 14 carrying sixteen separate cylindrically-shaped colorant containers 16, each of which is identical in construction. Bearings 17 are provided on the support 12 to smoothly guide rotation of the turntable 14. Each container 16 has a supply of liquid colorant and structure at 18 for dispensing a metered quantity of liquid from its associated container 16.

In operation, an open can 20, or other suitable receptacle containing a liquid base, is placed on a support surface for the apparatus so that the can 20 is beneath the turntable 14 in the path of the metering/dispensing structure 18. The turntable 14 is indexed to situate the desired colorant container 16 over the can 20. A plunger (not shown) associated with the metering/dispensing structure 18 is controlled by a vertically movable handle 22 which is raised a predetermined amount, gauged by a scale 24, to force a measured amount of the colorant into the can 20 upon release of a valve (not shown) through an associated crank handle 26. The operation is repeated for each required colorant until the desired proportions are deposited into the can 20 after which the contents thereof is mixed to produce a uniform, desired color.

A lid 46 is removably joined to the container. In the preferred embodiment, the lid is press fit over the open end 48 of each container 16. The lid 46 has a cylindrical body 50 with a central plug portion serving as the preferred joining means for fitting the lid to the container with a plug fit. The lid further includes an upwardly facing surface 51 to which a block 52 is secured by a bolt 54. The block 52 has a hollow 56 in which first and second meshing bevel gears 58, 60 on the shaft 38 and cable 42 reside. The lid 46 carries a bushing 62 in which the shaft 38 is journalled for rotation. The bevel gear 58 is carried on the shaft 38 and resides between the bushing 62 and a stop pin 63 and is biased upwardly into engagement with the gear 60 by a wave washer 64.

The gear 60 has a reduced diameter sleeve 66 which is journalled for rotation in a reduced diameter portion 67 of a stepped through bore 68 in the block 52. The larger diameter portion 70 of the bore 68 closely accepts the end 72 of the cable sheath 45 so that the cable 42 is held in a generally horizontal orientation in the vicinity of the block 52. Because the cable 42 is flexible, the lid 46 on the container 16 can be readily removed with the block 52 as a unit to facilitate checking and replenishing of the supply of colorant in the container 16. The U-shaped drive element 36, upon the lid 46 being removed, slides freely off of the pin 34 and, upon the lid 46 being removed, slides freely off of the pin 34 and, upon the lid 46 being replaced, slides readily back over the pin 34 for driving engagement therewith.

The drive for the individual cables 42 will now be described with respect to FIGS. 1, 2, 4 and 5. The motor 40 is fixed to the bottom of the support 12 as by bolts 74. Through a speed reduction mechanism 76, rotation is imparted to the shaft 78, which is journalled for rotation in bushing 80 extending vertically through both the support 12 and the turntable 14. Supported above the bushing 80 and in fixed relationship thereto is a gear housing 82 enclosing a gear train. The housing 82 consists of an upper, inverted cup-shaped half 84 and a disk-shaped base plate 86. The upper housing half 84 and base plate 86 cooperatively capture and support gears 88 for rotation relative thereto. The gears 88 correspond in number to the cables 42 and each is in mesh with a central drive gear 90 carried by motor shaft 78. The axes of rotation of gears 88 are spaced equidistantly from the axis of rotation of shaft 78. Each gear 88 has a cylindrical fitting 92 journalled for rotation in a bore 94 in a boss 96 depending from an upper, flat wall 98 of the housing half 84. Each fitting 92 has a blind bore 100 with a square cross section. The fitting 92 makes keyed connection with the end 102 of the cable core 44 so that the cable rotates with the gear 88 about its length. The cable sheath 45 is press fit into a reduced diameter portion 104 of the bore 94 in the boss 96 so that the cable extends generally vertically upwardly from the gear housing 82. The gear housing half 84 and base plate 86 are held together by bolts 106, thereby facilitating assembly and repair of the gear housing 82 and associated gears 88, 90.

A modified form of the colorant mixing and dispensing apparatus, according to the present invention, is shown in FIGS. 6–9 at 210. As in the prior embodiment, the apparatus 210 has a cylindrical base 212 with a turntable 214 supporting sixteen colorant containers 216, each having an associated metering/dispensing mechanism at 218. Each container 216 has an agitator 220 journalled for rotation therewithin as in the prior embodiment. Each agitator 220 has an associated cable 222 with an outer sheath 224 and a rotatable core 226, as in the prior embodiment. The core 226 at one end 228 of the cable 222 is rotated by a drive motor 229. The opposite, drive end 230 of the cable core 226 imparts rotation to a rotatable coupling mechanism at 232 for engaging, and imparting rotation from the core 226 at cable end 230 to the agitator 220.

Each container 216 has an open upper end 234 which is closed by a removable cover 236. The cover 236 has a cylindrical body 238 with an annular outer surface 240 closely matched in diameter to the diameter of the inside surface 242 of each container 216 so that the body 238 can be press fit into the open end of the container 216. A radially enlarged, annular rim 244 on the cover body 238 seats against the upper edge 246 of the container 216 with the cover 236 in its closed position. The cover 236 can be readily pressed with a plug fit into its closed position and removed therefrom by drawing the cover 236 upwardly in the direction of arrow 248 in FIG. 8 to a separated position (shown in phantom) wherein the inside of the container 216 and agitator 220 are exposed and readily accessible.

As in the prior embodiment, the agitator 220 has a shaft 250 with a pin 252 to be releasably engaged by an inverted U-shaped yoke 254 on the mechanism 232. The yoke 254 is fixed to a shaft 256, which is journalled for rotation in a sleeve 258 carried on the container cover 236. The shaft 256 has a rotational axis coincident with the rotational axis of the agitator shaft 250. The upper end of the sleeve 258 has a cylindrical opening 260 which closely, frictionally accepts the cable sheath 224. With the cable end 230 press fit in the opening 260, an exposed free end 262 of the cable core 226 is received in a socket connector 264 on the end of the shaft 256. The free core end 262 has a squared cross-sectional configuration matched to the socket 264 so that the core end 262 is keyed directly to the shaft 256 of the rotatable coupling mechanism 232, thereby obviating the need for bevel gears, etc.

By holding the cover 236 down in its closed position and drawing up on the cable end 230, the core end 262 can be freed from the shaft 256 to thereby disable the agitator 220. Alternatively, as in the prior embodiment, the cover 236 can be removed from the container 216 with the cable 222 intact so that the yoke 254 disengages from the agitator pin 252.

The cable end 228 is engageable with the drive motor 229 through a gear train or other gear arrangement 266, as in the prior embodiment, so that the cable end 228 can be press fit into and pulled out of operative engagement with the gear mechanism 266. A housing 268, surrounding the gear mechanism 266, has a boss 270 defining a cylindrical surface 272 which frictionally embraces the cable sheath 224 and maintains a vertical orientation of the cable 222 thereabove.

With the cable ends 228, 230 attached to their respective members, the cable 222 assumes an inverted U-shape with the apex 274 of the U residing above the top of the containers 216. The flexed cable 222 exerts a force tending to tilt the radially outwardmost portion of the cover 236 up. To prevent this, a lid 276 is provided. The lid 276, which is preferably made from a relatively heavy gauge metal, has a body 278 with an inverted, cup-shaped configuration conforming to the contour of the flexed cables 222, and an annular rim 280 extending radially outwardly from the body 278. The rim 280 has an underside surface 282 which bears against an upwardly facing surface 284 on each container cover 236. The weight of the lid is sufficient to overcome the force in the cables 222 tending to lift the covers 236 and maintain each of the covers 236 in its closed position during operation. The lid therefore can be seen to bias the cover into enclosing joinder with the container and to bias the rotatable coupling mechanism 232 into engagement with the agitator.

An annular lip 286 depends from the rim 280 and relatively closely surrounds the outer edges 288 of the containers 216 to provide for consistent orientation of the lid 276. The lid 276 is preferably held in place only under its own weight and can be readily removed to gain access to the individual containers 216. A U-shaped handle 290 is provided on the top of the lid 276 to facilitate manipulation thereof.

To prevent rotation of the covers 236 within the containers 216, each container 216 is provided with an integrally formed projection 292 (FIG. 9) which nests in a recess 294 in the lid 236 with the lid 236 in its closed position.

To maintain consistent orientation of the cables 222, an optional spacer plate 296 is provided. The plate 296 has a disc-shaped configuration and its peripheral edge has a plurality of notches 298 each dimensioned to frictionally grip a cable 222. The notches 298 are preferably spaced equidistantly around the periphery of the plate 296.

Figure 10:
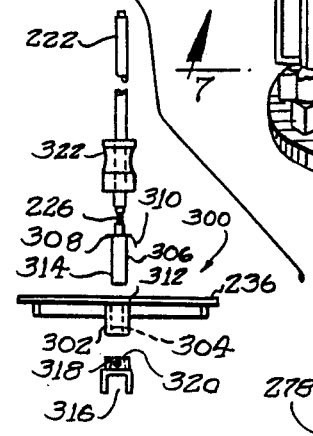
FIG. 10 is an exploded elevation view of one of the container covers and a modified mechanism thereon from that shown in FIG. 8 for connecting between one of the cables and an agitator.
Figure 8:
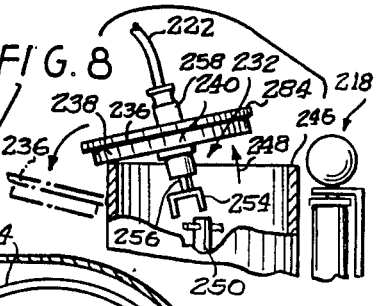
FIG. 8 is an enlarged, fragmentary, elevational view of one of the colorant containers on the dispensing apparatus of FIG. 6 with an associated lid partially removed from the container so as to disable an agitator within the container.
Figure 7:
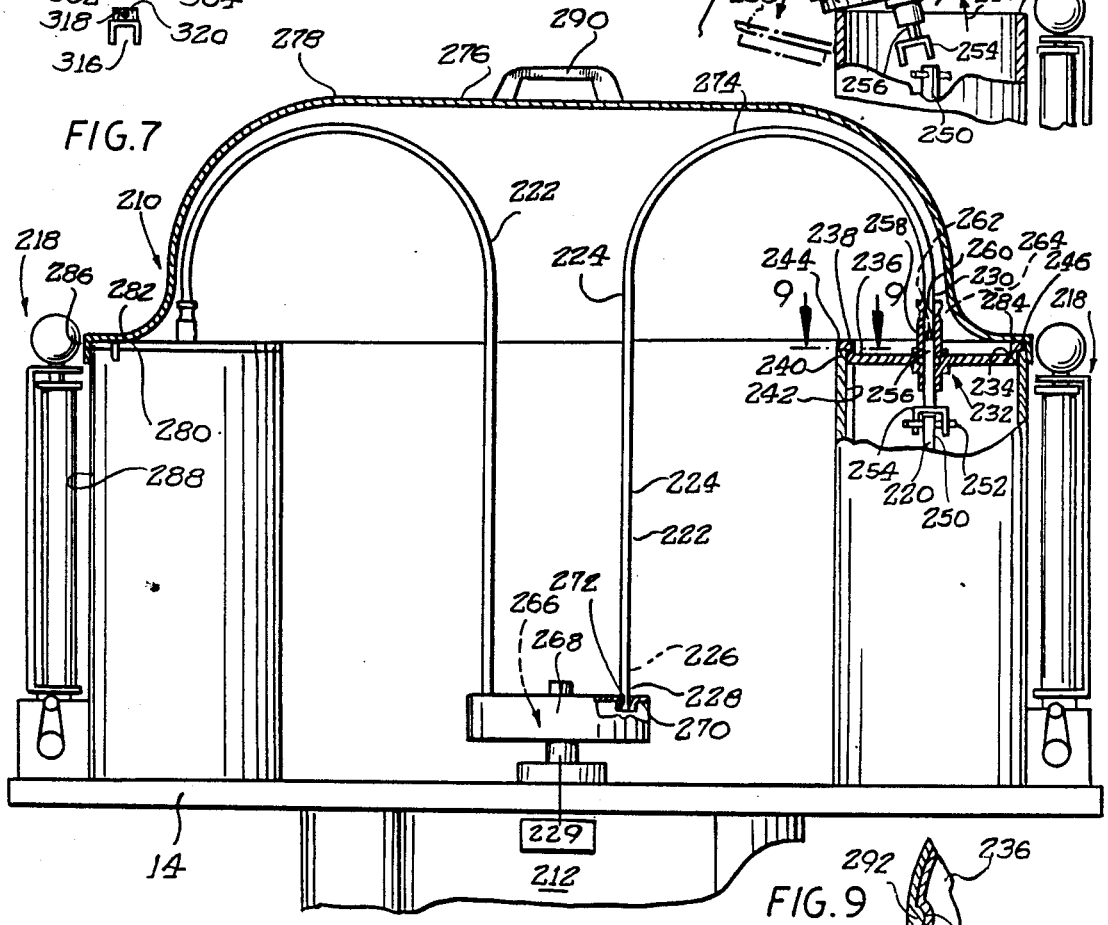
FIG. 7 is cross-sectional view of the mixing and dispensing apparatus taken along line 7—7 of FIG. 1.
Figure 9:
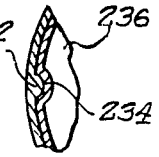
FIG. 9 is a cross-sectional view of the connection between one of the containers and a cover therefor taken along line 9—9 of FIG. 7.

In FIG. 10, a modified rotatable coupling mechanism from that in FIG. 8 is shown at 300 for connecting between each cable end 230 and agitator shaft 250. The cover 236 in FIG. 10 has an integrally formed cylindrical boss 302 with a through bore 304 in which a shaft 306, fixedly secured to the cable core 226 at the end 230 of the cable 222, is guided in rotation. The shaft 306 has a stop element 308 with a shoulder 310 that abuts the upper surface 312 of the boss 302 with the shaft 306 extended through the bore 304. With the shoulder 310 against the surface 312, the free end 314 of the shaft 306 is exposed beneath the boss 302. A yoke fitting 316 fits over the free end 314 of the shaft 306 and is secured thereto by a set screw 318. The boss 302 is thereby held captively between the shoulder 310 on the stop element 308 and an upwardly facing surface 320 on the yoke fitting 316. The sleeve 322 is slid along the cable 222 down against the stop element 308 and maintains the cable 222 in vertical orientation above the cover 236.

Figure 11:
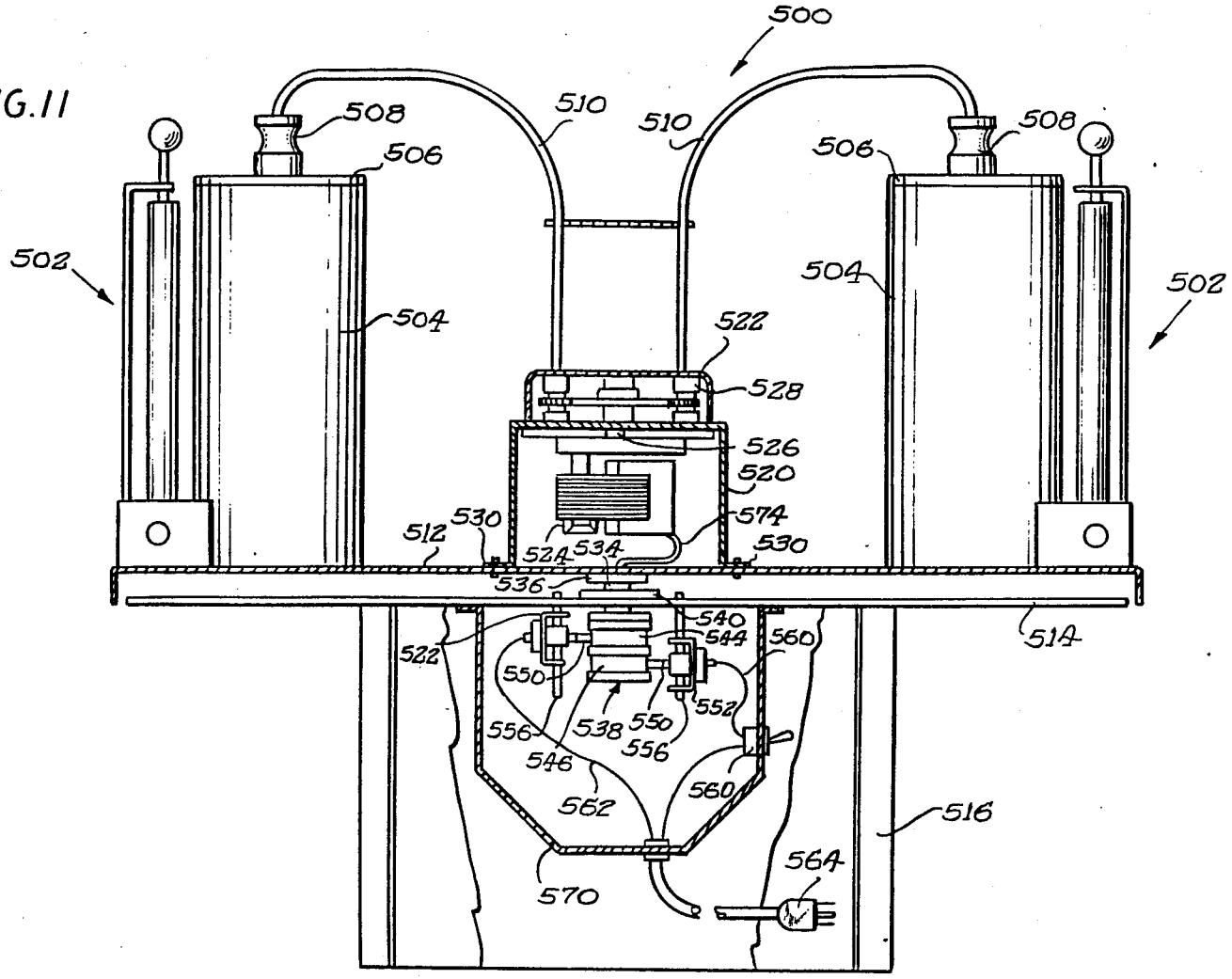
FIG. 11 is an elevational view of another alternative colorant mixing and dispensing apparatus according to principles of the present invention.

Referring now to FIG. 11, another alternative embodiment of a colorant mixing and dispensing apparatus, according to principles of the present invention, is shown at 500. A metering and dispensing structure 502 is similar to the mechanism described above with reference to FIG. 7. The containers 504 are also similar to the containers 216 described above and have similar removable covers 506 closely resembling the removable covers 236. Agitators, similar to those described above with reference to FIG. 7 are disposed within the containers 504 to maintain a consistent quality of the paint colorants disposed therein. Sleeves 508 and a rotatable coupling mechanism, not shown, but similar to those described above, provide a convenient coupling of the internal agitators to free ends of agitator drive cables 510.

While only two containers and agitator drive cables are illustrated in FIG. 11, it should be understood that a greater number of such systems can be employed in the apparatus 500. In the preferred embodiment, apparatus 500 includes 16 cylinders mounted on a turntable 512 which is rotatably supported by a support table 514 using bearings, not shown in FIG. 11. The turntable 512, support 514 and the bearings are substantially identical to their counterparts illustrated above in FIG. 2. The foregoing structure is supported by a cylindrical base 516 which can be positioned on a floor surface, for example.

As was seen above in the foregoing embodiments, an agitator drive system and the turntable upon which the canisters are mounted, rotate in parallel planes. When the agitator drive and turntable are rotated in opposite directions, the agitator drive, being relatively smaller, was observed to become loaded with an added burden attributed to the counter rotation of the turntable. This counter rotation is sensed by the agitator drive system through the agitators within the counter rotating cylinders and the paint colorant disposed therein. The amount of such additional burden is dependent upon the viscosity of the paint colorant, and other factors, so as to vary from operation to operation and from one installation to another. While such additional burden to the agitator drive system has not been found to be a serious problem, it is generally desirable to eliminate such added burden if at all possible.

As was seen above, the agitator drive system included flexible cables, speed reduction gears disposed within an intermediate gear housing, and a drive motor which rotatably drives the gears and flexible cable.

According to further aspects of the present invention, an alternative agitation drive system 515 included a drive motor 524 mounted to the turntable 512 so as to rotate therewith. Referring again to FIG. 11, a motor housing 520 is disposed between a gear housing 522, which is similar to the aforementioned gear housing 268 and the turntable 512. A drive motor 524 is disposed within housing 520 and includes an output shaft 526 rotatably driven thereby. The motor shaft 526 engages a gear mechanism 528 disposed within housing 522, to provide a speed reduction and torque increase for the flexible agitator drive cables 510. The lower ends 530 of housing 520 are secured to turntable 512 by welding, threaded fasteners or the like convenient fastening means.

A hollow mounting spindle 534 is connected at an upper end to a mounting plate 536 secured to the underneath surface of turntable 512. The lower end of spindle 534 is connected to a rotating commutator assembly generally indicated at 538. The rotating spindle 534 is inserted through a bushing 540 mounted to the upper surface of support table 514. The bushing includes thrust bearings to support the weight of the rotating components, which rotate as a single unit and which include the hollow spindle 534 and commutator assembly 538, along with the turntable 512 and the equipment supported thereon.

The rotating commutator assembly 538 includes a pair of commutator rings 544, 546 which are generally cylindrical in configuration and have outer conductive surfaces. Dielectric spacer rings (not numbered) are disposed adjacent the top and bottom edges of each commutator ring. Brushes 550 are mounted in holders 552 spaced about the commutator assembly 538. The brush mounts 552 are secured to rodlike posts 556 which are secured at their upper ends to the support plate 514. The brush mounts 552 can be adjustably moved about the rods 556 in order to provide an accurate alignment between the brushes 550 and the commutating rings 546, 544.

Electrical leads 560, 562 are terminated in an electrical plug 564 for connection to an external energy source. The conductor 560 is coupled to plug 564 through an on/off switch 566 which interrupts power to the drive motor 524. The brushes and commutator rings disposed in housing 570 provide continuous electrical feed to conductors 574 which provide electrical connection to drive motor 524.

The commutator assembly, brushes and their respective mounting apparatus is enclosed within a housing 570 secured to the underneath surface of support plate 514. The housings 520, 570 protect the components within from any liquid material that might be spilled on turntable 512. With the alternative agitation drive system illustrated in FIG. 11, the agitation drive motor 524 rotates along with the cylinders 504, thus eliminating any added burden on the drive system due to rotation of the agitation and turntable drive systems.

Those skilled in the art will readily appreciate that commutator rings and brushes of different configurations can be employed in the practice of the present invention, it being recognized that a variety of conventional connector systems are available for connecting circuit parts which undergo a relative rotation during operation of the electrical circuit.

Several modifications can be made to the above preferred embodiments. For example, it has been found convenient to provide the dispensing and mixing apparatus with a lid enclosing the containers, agitator drive system, and other operating mechanisms. As mentioned above, the lid conveniently bears against the covers enclosing the upper open ends of the containers, to maintain closure of the containers and to maintain engagement of the fork-like couplings to the agitators disposed within the containers. If, however, it is desirable to expose the containers and mechanisms mounted on the turntable, the lid can be replaced by a ring having the dimensions of the peripheral lip of the lid illustrated in FIG. 7. The ring can thereby be provided which contacts the covers to provide the desired weighting or downward bearing force. The rings can either be massive enough to provide the desired bearing force, or a number of clamps can be installed which pull the ring downwardly toward the turntable.

The drawings and the foregoing descriptions are not intended to represent the only forms of the invention in regard to the details of its construction and manner of operation. Changes in the form and in the proportion of parts, as well as the substitution of equivalents, are contemplated as circumstances may suggest or render expedient; and although specific terms have been employed they are intended in a generic and descriptive sense only and not for the purpose of limitation, the scope of the invention being delineated by the following claims.

What is claimed is:

1. In a paint colorant dispenser and mixer apparatus including a plurality of colorant containers each having an open upper end, means for mounting an agitator for rotation within each colorant container for mixing colorant therein, a plurality of agitator drive cables each having a drive end and a driven end, and drive means for rotating the driven ends of the cables to thereby effect rotation of the drive ends of the cables, the improvement comprising:

a plurality of container covers to close the open ends of the containers;

joining means on each cover and container for releasably joining the covers to the containers;

rotatable coupling means carried on the covers for releasably engaging the agitator within a container enclosed by the cover and for disengaging the agitator when the cover is withdrawn from said container, and said rotatable coupling means further comprising connector means for connecting the drive ends of the cables to the rotatable coupling means on the covers to impart rotation to the rotatable coupling means; and biasing means for biasing the covers against the containers to maintain the closure thereof and to maintain engagement of the rotatable coupling means with their associated agitators when said agitators are rotatably driven within said containers.

2. The apparatus according to claim 1 wherein the drive ends of said cables are rotatable about the rotational axes of the agitators with which the cables are associated and wherein the drive ends are connected to the rotatable coupling with the covers enclosing the containers.

3. The apparatus according to claim 1 wherein the biasing means comprises a lid covering said containers, said lid having a cover-engaging portion for engaging the covers associated therewith.

4. The apparatus according to claim 3 wherein each cable is arched between the drive means for rotating the driven ends of the cables and the rotatable coupling means so as to define an inverted U-shape with an apex above a cover enclosing the container and the lid has a body with an inverted cup-shaped configuration that conforms generally to the contour of the arched cables and a rim comprising said biasing means extending radially outwardly from the lid body for bearing against the container covers.

5. The apparatus according to claim 4 wherein the cover-engaging portion of the lid comprises a rim with an annular depending lip which extends peripherally around and cooperates with the containers to maintain the lid in a predetermined position relative to the containers with the lid in its operative position.

6. The apparatus according to claim 5 wherein said lid bears downwardly against all of the container covers in its operative position.

7. The apparatus according to claim 1 further comprising a turntable for rotatable mounting of said colorant containers and wherein said drive means comprises a motor mounted on said turntable for rotation therewith for rotatingly driving said cables and the agitators coupled thereto.

8. In a paint colorant dispenser and mixer apparatus including a plurality of colorant containers each having an open upper end, means for mounting an agitator for rotation within each colorant container for mixing colorant therein, a plurality of agitator drive cables each having a drive end and a driven end, and drive means for rotating the driven ends of the cables to thereby effect rotation of the drive ends of the cables, the improvement comprising:

a plurality of container covers to close the open ends of the containers;

rotatable coupling means carried on the covers for releasably engaging the agitator within a container enclosed by the cover and for disengaging the agitator when the cover is withdrawn from said container, and said rotatable coupling means further comprising connector means for connecting the drive ends of the cables to the rotatable coupling means on the covers to impart rotation to the rotatable coupling means;

a turntable for rotatable mounting of said colorant containers;

said drive means comprising a motor mounted on said turntable for rotation therewith; and motor connecting means for connecting the agitator drive cables to the drive motor.

9. The apparatus of claim 8 wherein the motor connecting means comprises a gear train having an input connected to said drive motor and a plurality of outputs connected to the agitator drive cables.

10. The apparatus of claim 8 wherein the rotatable coupling means comprises a shaft rotatable about a vertical axis and said motor connecting means comprises key means on said shaft for making releasable keyed connection with the drive end of one of the cables.

11. In a paint colorant dispenser and mixer apparatus having first and second colorant containers each having an open upper end, means for mounting an agitator for rotation about a substantially vertical axis in each colorant container for mixing colorant therein, first and second cables each having a drive and a driven end, and means for rotating the driven ends of the cables to thereby effect rotation of the drive ends of the cables, the improvement in which:

first and second container covers are provided to close the open ends of the first and second containers, there being cooperating means on each cover and container for releasably press fitting each cover into a closed position by moving each cover downwardly against it associated container, each said cover being movable upwardly relative to its associated container from its closed position to a separated position;

rotatable means on the first cover for engaging and imparting rotation to the agitator associated with the first container with the first cover in its closed position and for disengaging the agitator associated with the first container with the first cover in its separated position;

rotatable means on the second cover for engaging and imparting rotation to the agitator associated with the second container with the second cover in its closed position and for disengaging the agitator associated with the second container with the second cover in its separated position;

means for connecting the drive ends of the first and second cables to the rotatable engaging means on the first and second covers to impart rotation to the rotatable engaging means; and a lid for biasing downwardly against the first and second covers to maintain the first and second covers in their closed position and the rotatable means engaged with the agitators with the lid in an operative position.

12. The apparatus according to claim 11 wherein the drive ends cf the first and second cables are rotatable about substantially vertical axes with the drive ends connected to the rotatable engaging means and the first and second covers in their closed position.

13. The apparatus according to claim 11 wherein the drive ends of the first and second cables are rotatable about substantially vertical axes coincident with the rotational axes of the agitators with which the cables are associated with the drive ends connected to the rotatable means and the first and second covers in their closed position.

14. The apparatus according to claim 11 wherein each cable is arched between the means for rotating the driven ends of the cables and the rotatable engaging means so as to define an inverted U-shape with an apex above the covers with the covers in their closed position and the lid has a body with an inverted cup-shaped configuration that conforms generally to the contour of the arched cables and a rim extending radially outwardly from the lid body for biasing against the container covers.

15. The apparatus according to claim 14 wherein there are a plurality of containers with covers in addition to said first and second containers in annular arrangement with the first and second containers and the rim on the lid has an annular depending lip which extends peripherally around and cooperates with the containers to maintain the lid in a predetermined position relative to the containers with the lid in its operative position.

16. The apparatus according to claim 15 wherein said lid bears downwardly against all of the container covers in its operative position.

17. The apparatus according to claim 11 wherein a base is provided and there are a plurality of containers with covers in addition to said first and second containers in annular arrangement with the first and second containers on said base.

18. In a paint colorant dispenser and mixer having first and second colorant containers each having an open upper end, means for mounting an agitator for rotation about a substantially vertical axis in each colorant container for mixing colorant therein, first and second cables each having a drive and a driven end, and means for rotating the driven ends of the cables to thereby effect rotation of the drive ends of the cables, the improvement in which:

first and second container covers are provided to close the open end of the first and second containers, each said cover being movable upwardly relative to its associated container from its closed position to a separated position;

rotatable means on the first cover for engaging and imparting rotation to the agitator associated with the first container with the first cover in its closed position and for disengaging the agitator associated with the first cover with the first cover in its separated position;

rotatable means on the second cover for engaging and imparting rotation to the agitator associated with the second container with the second cover in its closed position and for disengaging the agitator associated with the second container with the second cover in its separated position; and means for connecting the drive ends of the first and second cables to the rotatable engaging means associated with the first and second covers so that the drive ends of the first and second cables are substantially coaxial with the axes of the agitators in the container with which the cables are associated.

19. The apparatus according to claim 18 wherein the rotatable engaging means on each of the first and second containers includes a shaft rotatable about a vertical axis and means on each shaft for making releasable keyed connection with the drive end of one of the cables.

20. The apparatus according to claim 19 wherein there is a yoke at the end of each shaft for releasably engaging and driving one of the agitators.

21. The apparatus according to claim 19 wherein each said cable has a flexible sheath and a rotatable core and a sleeve projects vertically upwardly from each said container cover to receive one of the flexible sheaths and maintain vertical orientation of the one flexible sheath above the closed container cover with the drive end of the one flexible sheath keyed to one of the shafts on the rotatable engaging means.

22. The apparatus according to claim 21 wherein said means for rotating the driven ends of the cables includes means for maintaining the driven ends of the cables in a substantially vertical orientation.

23. The apparatus according to claim 22 wherein means are provided for engaging said first and second cables between the drive and driven ends thereof and maintaining a predetermined spacing between said first and second cables.

24. The apparatus according to claim 22 wherein said means for rotating the cables resides below the upper ends of the containers so that each said first and second cable has a bowed, inverted U-shape.

25. The apparatus according to claim 24 including a lid having a configuration matched approximately to the contour of the bowed portions of the cables, there being cooperating means on the lid and container for supporting the lid so that the lid shields the cables and means for rotating the cables.

26. The apparatus according to claim 25 wherein the cooperating means on the lid and container comprises an upwardly facing surface on each container lid and a rim on the lid having a downwardly facing surface for simultaneously biasing against the upwardly facing surfaces on the containers to thereby maintain the covers in their closed positions.

27. In a paint colorant dispenser and mixer apparatus having a plurality of colorant containers each having a cover and an agitator, a drive gear located centrally of said containers and cables each having a flexible sheath and rotatable core connecting the drive gear with each of the agitators, the improvement in which:

each cable is oriented substantially at right angles to the container covers with the sheath attached to the cover of the associated container and the core connected with the agitator, each cable arching from the drive gear up to an apex and down to the container cover; and a lid extending over the arched cables, confining the cables, and retaining the container covers seated on the containers.

28. In a paint colorant dispenser and mixer apparatus having first and second colorant containers each having an open upper end, means for mounting an agitator for rotation about a substantially vertical axis in each colorant container for mixing colorant therein, first and second cables each having a drive end connected to an agitator and a driven end, and means for rotating the driven ends of the cables to thereby effect rotation of the agitator through the drive ends of the cables, the improvement in which:

first and second container covers are provided to close the open end of the first and second containers, there being cooperating means on each cover and container for releasably fitting each cover into a closed position against its associated container; and a lid for simultaneously biasing downwardly against the first and second covers to maintain the first and second covers in their closed position.

* * * * *